United States Patent [19]

Farina

[11] 4,006,850

[45] Feb. 8, 1977

[54] DISPENSING MECHANISM

[76] Inventor: John Farina, 5745 N. Washtenaw, Chicago, Ill. 60659

[22] Filed: Aug. 25, 1975

[21] Appl. No.: 607,291

[52] U.S. Cl. ..... 222/356; 222/173; 222/569; 248/146

[51] Int. Cl.[2] ..... G01F 11/10

[58] Field of Search ..... 222/356–358, 222/167–170, 172, 173, 180, 184, 569, 570, 160, 186; 248/146, 150, 131, 151, 154, 431, 435; 220/69, 85 H; 211/71, 78

[56] References Cited

UNITED STATES PATENTS

| | | | |
|---|---|---|---|
| 672,046 | 4/1901 | Taylor | 248/154 |
| 980,066 | 12/1910 | Collins | 222/356 |
| 1,218,092 | 3/1917 | Larsen | 222/356 |
| 2,354,348 | 7/1944 | Polsen et al. | 222/357 |
| 2,384,112 | 9/1945 | Meyer | 248/146 |
| 3,043,465 | 7/1962 | Horner | 220/69 |
| D175,498 | 2/1955 | Easton | 248/150 |

FOREIGN PATENTS OR APPLICATIONS

| | | | |
|---|---|---|---|
| 1,534,069 | 6/1968 | France | 222/569 |
| 1,513,468 | 1/1968 | France | 222/569 |

*Primary Examiner*—Drayton E. Hoffman
*Assistant Examiner*—H. Grant Skaggs
*Attorney, Agent, or Firm*—John J. Kowalik

[57] ABSTRACT

A dispenser for candy or the like comprising a bottom bowl and an upper transparent cover through which a spoon is extended for dipping into the bowl to lift a spoonful of the contents and thereafter spilling it into a dispensing chute for discharge into the hand of a recipient. A deflectible cover is rotatably secured with the bowl to a support stand by a novel interlocking arrangement wherein the rim of the deflectible cover and the deflectible bowl are snapped into notches provided in the stand to form a unitary structure so that the removal of the cover is not readily discernable to prevent persons uncovering the device and reaching into the bowl to take excessive amounts of the sweets or because of dirty hands possibly contaminating the remaining contents. Also the rotational facility of the cover allows partitioning of the bowl so that different items may be placed at opposite sides of the partition and the cover rotated to accessibly position the spoon for right or left hand manipulation.

9 Claims, 7 Drawing Figures

DISPENSING MECHANISM

DISCUSSION OF THE PRIOR ART

U.S. Pat. Nos. 980,066 and 1,218,092 show a bowl and cover and a ladle which operates it either through an opening in the cover or bowl to dispense items through a spout. In each the support stand is integral with the bowl. The cover and bowl are rigid and if interlocked cannot be relatively rotated.

SUMMARY OF THE INVENTION

This invention is directed to a novel dispensing device in which the cover and the bowl are interlocked with the support stand in a manner wherein the several parts are held together in a unitary assembly without the necessity of forming complicated shapes of the parts to interlock the same.

A general object is to devise a novel dispenser in which the parts are so formed that they are simple to manufacture and are easy to assemble and dismantle for cleaning and washing to meet sanitation requirements of the regulations of various communities.

A specific object of the invention is to provide a novel dispenser comprising a container having hemispherical upper and lower cover and bowl portions which are relatively rotatable along mating edges which are provided with outwardly extending rim flanges, the cover and bowl being formed of plastic materials such as polyethylene or the like, and are flexible and temporarily deformable at their rim edges for insertion and removal of the rims while deformed with respect to notches in peripherally intersecting legs of a support stand within which the bowl is nested.

Another object of the invention is to provide a novel skeletal container stand in which the legs of the stand are positioned edgewise tangentially of the bowl in minimal contact therewith to minimize abrasion between the bowl and the stand during relative rotation therebetween as well as to facilitate such rotation.

Another object is to provide a simple stand in which a plurality of identical countersupporting parts are uniquely interconnected to form the support stand whereby minimizing inventory of parts and at the same time providing an effective structure.

A further object is to provide a novel sleeve-like extrusion about the spoon-admitting aperture in the cover portion of the container which serves to provide an enlarged bearing area for the spoon, and also serves to prevent water or other cleaning fluid from flowing into the container when the top is being washed.

These and other objects of the invention inherent in and encompassed in the invention will become more readily apparent from the specification and drawings, wherein.

DESCRIPTION OF THE INVENTION

Figure 1:
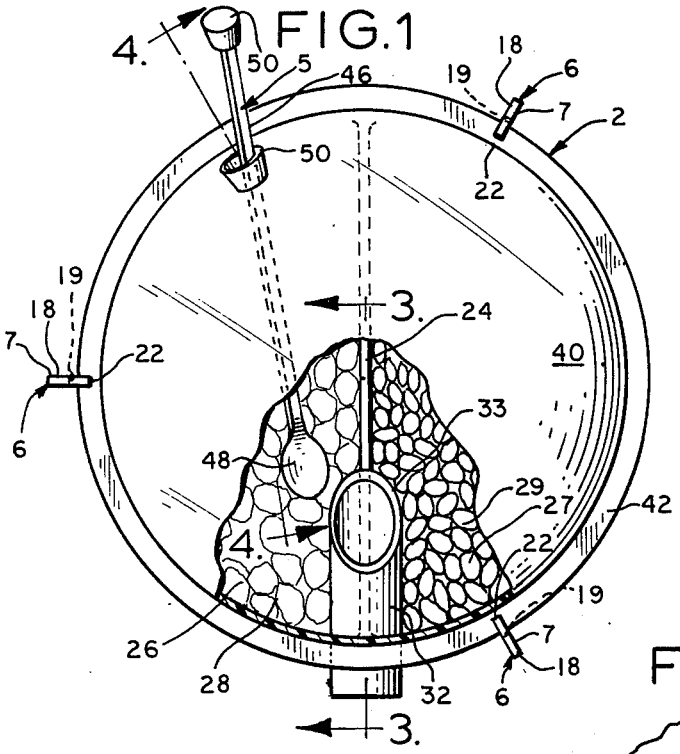
FIG. 1 is a top plan view of my novel dispenser partly broken away.
Figure 4:
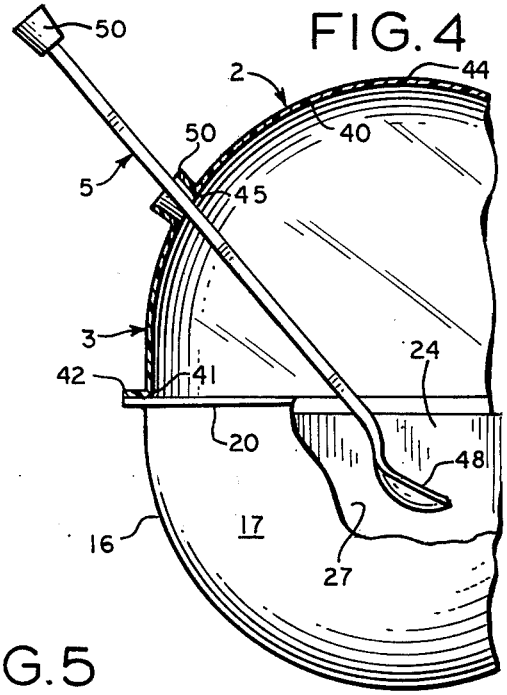
FIG. 4 is a vertical sectional view taken substantially on line 4—4 of FIG. 1.

The dispenser generally designated 2 in the drawings comprises a container broadly indicated 3, a support stand 4 and a dispensing spoon or ladle 5.

Figure 7:
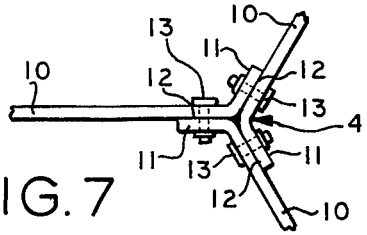
FIG. 7 is a top plan view of the junction portion of the legs of the stand taken substantially at 7—7 of FIG. 2.
Figure 6:
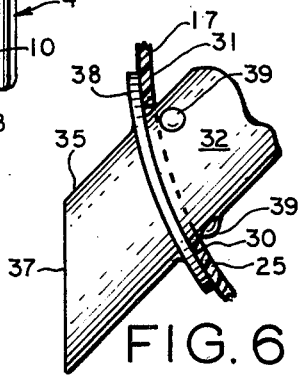
FIG. 6 is a fragmentary enlarged view of FIG. 3 showing the spout in side elevation.

The stand 4 is constituted of three L-shaped bracket members 6, each of which has a vertical leg 7, which at its lower end terminates in a foot 8 for resting upon a table or countertop. The leg 7 is connected adjacent to its lower end to a horizontal leg 10 which, at its distal terminous, is formed with an attachment lug portion 11 which is angled 120° from the plane of its leg portion 10. The three lugs 11 are assembled as shown in FIG. 7, wherein the lug 11 of each bracket member 7 is positioned as at 12 against a side of one of the other two legs 10 and is secured thereto as by a rivet 13. The lugs 11 and legs 10 are disposed in a triangular arrangement as seen in FIG. 7, thus mutually supporting each other and a single rivet is used, not only to attach the respective bracket to the adjacent one but that rivet also serves to prevent pivotal movement of the bracket to which it is connected from pivoting about the rivet connecting its respective attachment lug to the other of the brackets.

Figure 5:
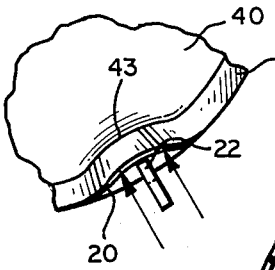
FIG. 5 is a fragmentary top view of the cover illustrating a deflected condition of its rim portion.
Figure 2:
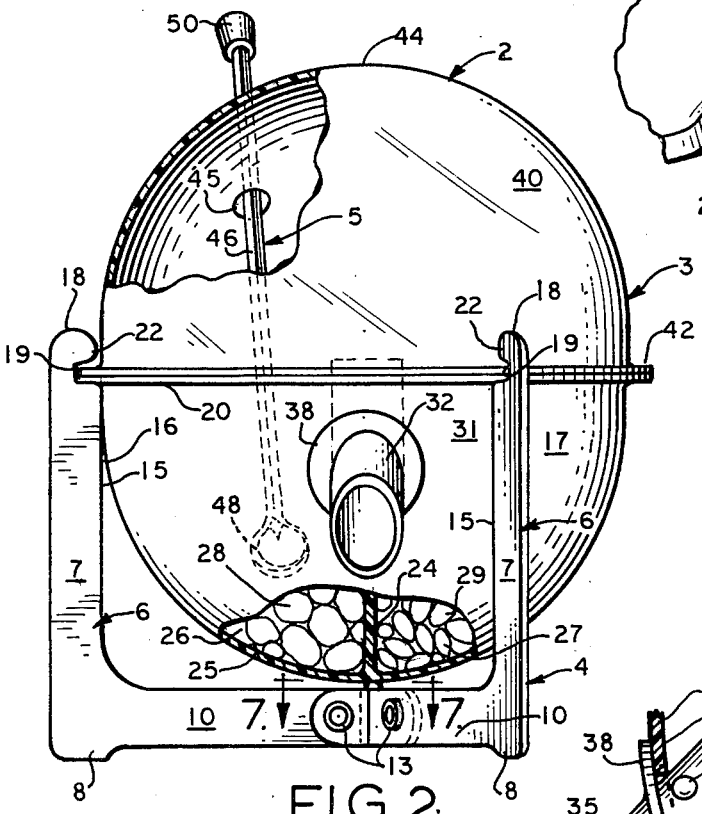
FIG. 2 is a side elevational view of the dispenser, the cover being partly broken away and shown in cross-section.
Figure 3:
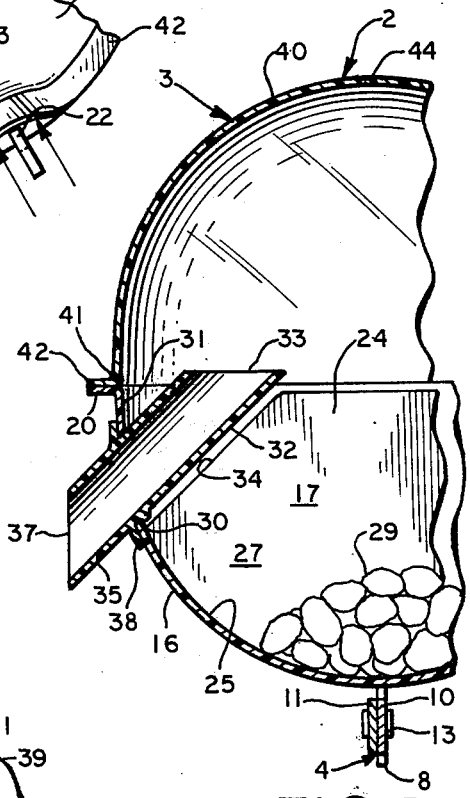
FIG. 3 is a vertical sectional view taken substantially on line 3—3 of FIG. 1.

As best seen in FIGS. 1 and 7 the three brackets 6 are spaced equidistantly (120°) apart and that the vertical leg 7 of each bracket has its inner edge 15 positioned tangentially with respect to the outer contour 16 of the bowl 17 which is cradled in the support stand. The upper end of each leg 7 is rounded at 18 and at the inner edge 15 is provided with a horizontal notch 19 which admits an annular peripheral rim 20 formed on the edge of the bowl. The bowl, being of flexible plastic material such as polyethylene or polypropylene or the like, is flexible and capable of being deflected out of the notch to permit withdrawal and lifting beyond the overhanging hook portion 22. The bowl preferably is formed with a diametrical divider 24 which divides the interior 25 of the bowl into two compartments 26,27 which may hold either two different type of sweets or sweets 28 in one compartment and nuts 29 in the other. The bowl is provided with an opening 30 at the vertical portion 31 through which there is extended a tubular, preferably cylindrical, flexible plastic spout 32 which is sheared horizontally at its upper end to provide an upper horizontal edge 33. The spout extends diagonally along the cut out edge 34 (FIG. 3) of the partition and has a lower end portion 35 projecting outside the bowl and has a vertically sheared lower edge 37. A shoulder 38 is formed about the body of the spout intermediate its ends and bears against the external side of the bowl in the region about the opening 30. The shoulder or annulus 38 is frusto-conical and, being flexible, is adapted to flare outwardly as the spout is forced into the opening 30 from the outer side of the bowl, forcing a plurality of hemispherical nibs 39,39, formed on the tube and spaced inwardly of the annulus, through the opening 30 by expanding and deflecting the plastic bowl material about the opening. The nibs or locking elements, being hemispherical, wedge through the opening 30 and wedge against the interior 25 of the bowl, thus urging the shoulder 38 into tight stressed engagement with the exterior of the bowl. The cover portion 40 of the container is also hemispherical shape and has a lower edge 41 which is provided with an onturned peripheral rim flange 42 which rides upon the peripheral flange 20 of the bowl portion of the container. The rim 42 is snapped into the slots or notches 19 in the legs of the support stand by deflecting the plastic material forming the cover as at 43 and best seen in FIG. 5 to bypass the hook portions 22. Thus, both the top and bottom are relatively rotatable with respect to the stand, although the spout restricts the extent of rotary movement of the bowl. The cover is provided midway between its lower edge and the crest of curvature indicated at 44 of the top or cover with an opening 45 through which is extended the handle 46 of a ladle or spoon 5 which has a scoop 48 at its inner end. The spoon is adapted to be manipulated at its outer end 50 to dip into the sweets and scoop a spoonful out and drop this amount through the spout. It will be realized that the cover may be readily rotated with respect to the bowl portion and the stand to position the spoon accessibly to the items intended to be scooped out of the bowl. Inasmuch as the scoop of the spoon is larger than the opening 45 it cannot be withdrawn from the container. The opening 45 is circumscribed by an outwardly projecting sleeve or tube 50 which, in addition to providing an extrusive bearing area, also serves to prevent fluid, when applied above the opening, from flowing through the opening into the bowl.

A preferred embodiment of the invention has been disclosed, illustrating the best mode of utilizing the invention. It will however be apparent that various modifications can be effected in view of the foregoing disclosure which fall within the scope of the appended claims.

I claim:

1. A dispenser, comprising a container having a bowl for holding dispensible items, a transparent cover mounted over the bowl, a discharge spout extending from the interior of the bowl through an opening therein, a ladle extending through an opening in said cover and adapted to be moved to a position of accessibility to the items by rotating the cover and thereafter manipulated to scoop the items from the bowl and transfer them to the spout for discharge to a recipient, and a support stand mounting said container and comprising means for rotatably interlocking said cover and bowl with each other and with the stand, at least said cover being formed of plastic material and being deflectible to engage and disengage said cover with respect to said interlocking means, and said stand having legs positioned about the peripheries of the cover and the bowl, and said cover and bowl each having an outwardly projecting rim, and said interlocking means comprising rim-receiving notches in said legs.

2. The invention according to claim 1, and said cover and bowl each being substantially hemispherical and said legs of the stand being vertical and extending edgewise tangetially to said cover and bowl.

3. The invention according to claim 2 and said stand having horizontal legs extending inwardly from respective vertical legs, beneath the bowl, and means interconnecting said horizontal legs at their ends remote from the vertical legs.

4. The invention according to claim 1 and contamination-preventing means integrally formed on the cover about said opening for admitting the spoon therethrough and comprising a tubular extension projecting outwardly from the periphery of the cover and completely encompassing said opening.

5. The invention according to claim 1 and said stand comprising three L-shaped brackets, each bracket comprising a vertical leg and a horizontal leg, each horizontal leg having a laterally angled tab, means attaching the tab of each horizontal leg to the horizontal leg of an adjacent bracket prominate to the tab thereon, said interlocking means comprising a convexly curved upper edge on the upper end of each leg for engagement by the cover and bowl, which is also formed of flexible plastic material and deflectible with the cover inwardly of the legs, the curvature of said upper edge of the vertical legs adapted to facilitate movement of the rims with respect to said notches in the legs.

6. The invention according to claim 1 and said spout comprising a tubular element having a frusto-conical flexible annulus adapted to seat against the external side of the bowl about said opening therein, the fastener means adapted to be forced through said opening in said bowl attendant to distortion of the margins of said opening and to wedge behind the wall of said bowl to releasably hold the spout in assembly therewith.

7. The invention according to claim 6 and said fastener means comprising at least one outward projection on said spout having wedge surfaces thereon for wedging engagement with the wall of said bowl.

8. The invention according to claim 1 and said bowl also being formed of flexible plastic material, and said stand having vertical legs embracing said cover and bowl therebetween and said legs having inner edges facing said container, and said rims mutually engaging and accommodating relative rotation therebetween and said notches extending inwardly form said inner edges of the legs and receiving the rims of the cover and bowl therein.

9. The invention according to claim 8 and said legs having upper end portions with upwardly facing arcuate edges for engagement by said rims to deflect the same to enter respective notches attendant to the cover and bowl being pressed downwardly and inwardly to deflect the same.

* * * * *